United States Patent [19]

Thompson

[11] 4,219,895

[45] Sep. 2, 1980

[54] VARIABLE VOLUME FLUSHING CISTERN

[75] Inventor: Bruce R. Thompson, Tranmere, Australia

[73] Assignee: United Packages limited, Australia

[21] Appl. No.: 964,825

[22] Filed: Nov. 30, 1978

[30] Foreign Application Priority Data

Dec. 6, 1977 [AU] Australia ..... PD2675

[51] Int. Cl.[2] ..... E03D 1/14

[52] U.S. Cl. ..... 4/325; 4/346; 4/364; 4/390; 4/410

[58] Field of Search ..... 4/324–327, 4/340–342, 345, 346, 363–365, 378, 390, 392, 393, 410, 413, 414, 415, 249, 379, 380, 391, 395, 396, 405

[56] References Cited

U.S. PATENT DOCUMENTS

| | | | |
|---|---|---|---|
| 72,810 | 12/1867 | Craigie | 4/364 |
| 320,625 | 6/1885 | Carney | 4/346 |
| 354,701 | 12/1886 | Harvey | 4/364 |
| 370,433 | 9/1887 | Wellington | 4/346 |
| 413,568 | 10/1889 | Wellington | 4/364 |
| 1,323,703 | 12/1919 | Linfoot | 4/325 |
| 2,436,679 | 2/1948 | Sprague | 4/410 |
| 3,041,630 | 7/1962 | Williams | 4/326 |
| 3,810,261 | 5/1974 | Hollander | 4/390 |
| 3,842,444 | 10/1974 | Gruenhagen | 4/363 X |
| 4,143,430 | 3/1979 | Joshi | 4/324 |

FOREIGN PATENT DOCUMENTS

| | | | |
|---|---|---|---|
| 2626053 | 1/1977 | Fed. Rep. of Germany | 4/324 |

*Primary Examiner*—Stuart S. Levy

*Attorney, Agent, or Firm*—Kinzer, Plyer, Dorn & McEachran

[57] ABSTRACT

A variable volume flushing cistern comprising a body with a division wall across it to form two compartments, the first containing a float and water inlet valve and communicating with a flushing valve on the base of the cistern, a second communicating through a movable flap with the flushing valve so that by closing the valve water from the second compartment can be prevented from discharging through the flushing valve when a smaller flush is required.

7 Claims, 3 Drawing Figures

VARIABLE VOLUME FLUSHING CISTERN

This invention relates to a variable volume flushing cistern and in particular it relates to a cistern of the type in which a selection can be made of the amount of water discharged during a flush.

THE PRIOR ART

It is already known to provide cisterns in which either a low volume or a high volume discharge is possible by selection and these usually have been of the type in which either part of the cistern or the whole of the cistern can be discharged during a flush.

This has for instance been achieved by operating the discharge valve to seat when a certain selected level of water is reached, or it has been attained by use of compartments which vary in volume.

In apparatus of this type it is desirable to achieve the variable flush in a simple manner and one which is reliable in operation to ensure correct flushing of the toilet pan.

OBJECT OF THE INVENTION

An object of the present invention is to provide a simple and effective form of device of this nature while retaining the normal type of flushing apparatus.

SUMMARY OF THE INVENTION

The object is achieved by having a first compartment which includes the flushing valve, and a second compartment which is isolated from the flushing valve but is provided with a flap whereby the second compartment can also be placed into communication with the flushing valve.

The flap can be controlled by a simple volume control member or there can be two push buttons one to release the larger volume of water and the other the smaller volume.

The actual construction of the unit can be varied within the spirit of the invention but according to a convenient form the cistern and flushing valve are constructed as heretofore but the first and second compartments are formed by placing a division wall across the cistern body with a float in the first compartment and a water inlet in the second compartment actuated by the float, the flushing valve being disposed in the first compartment but isolated from the second compartment by a flap which can move into a position where it closes off the second compartment from the first compartment and the flushing valve, but by appropriately moving the flap flow can take place to the flushing valve both from the second compartment and the first compartment.

DESCRIPTION OF THE PREFERRED EMBODIMENT

Figure 1:
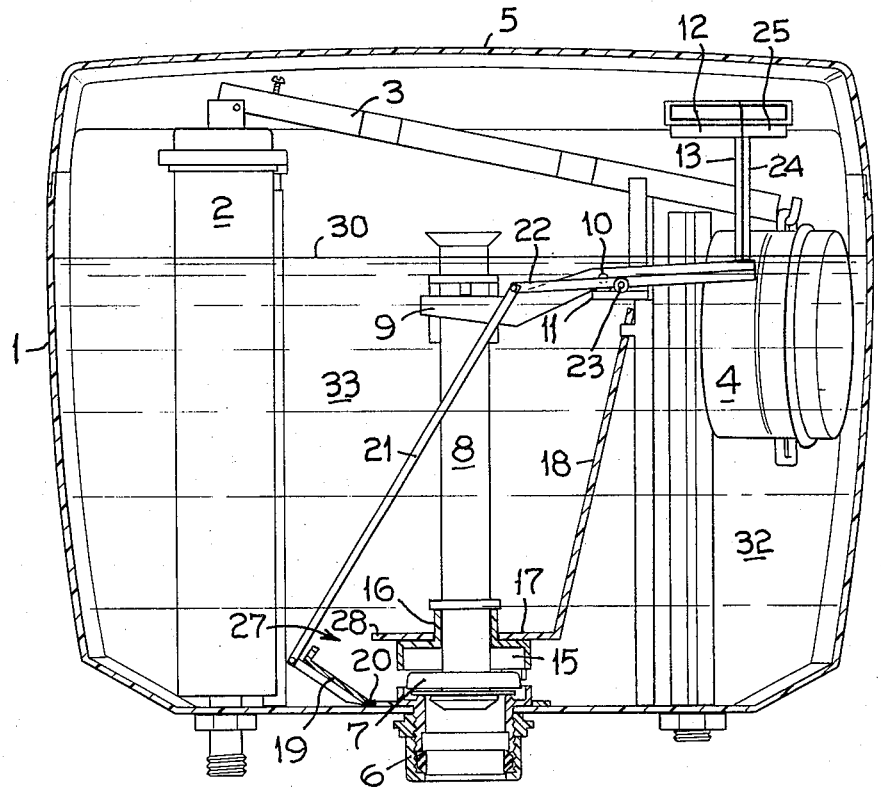
FIG. 1 is a transverse section of the cistern showing the valve sectioned and showing its relationship to the first and the second compartment, showing the position of the valve and flap and associated subchamber before a flush is initiated.
Figure 2:
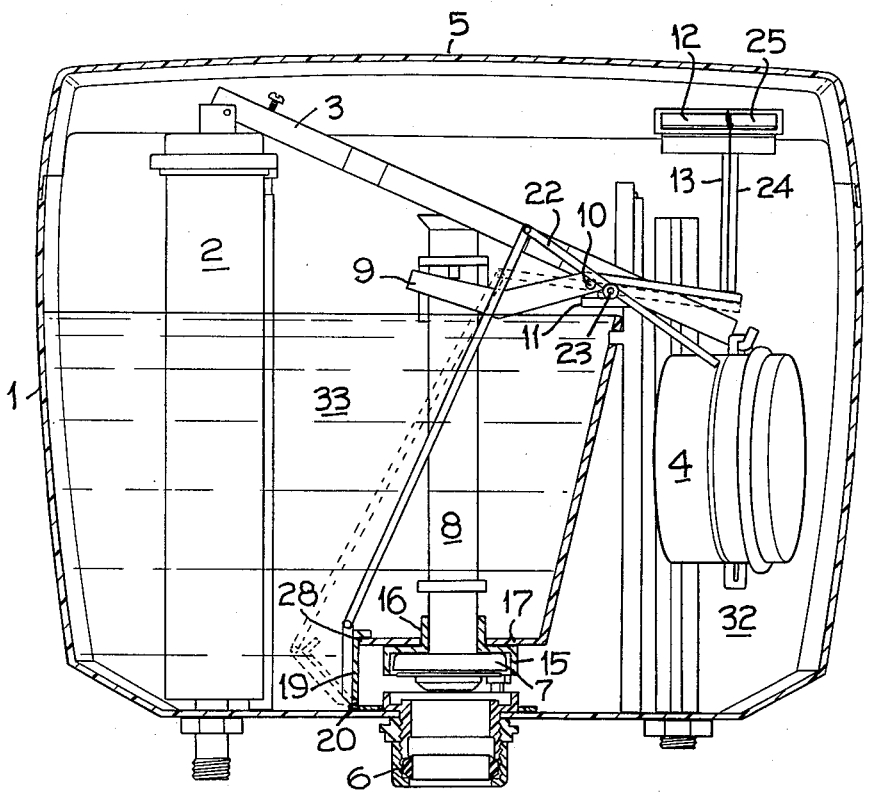
FIG. 2 shows the position after a smaller volume flush is completed, but showing the flushing valve and flap in the position they occupy, during the flush.

The body 1, comprising sides and a floor, of the cistern has within it a water inlet valve 2 which is operated through an arm 3 by a float 4 in any usual or approved manner.

The body is closed by a lid 5.

Through the base of the body 1 is positioned an outlet member 6 which is adapted to engage a flush pipe, not shown, and on this outlet member 6 is the flushing valve 7 which again can take any usual approved form but according to the form shown is a flat disc fitted to a hollow operating stem 8 which forms the cistern overflow and which is engaged by a lever 9 which forms a first flush initiating member, having its fulcrum 10 supported on a bracket 11 secured to the body 1 itself, the lever 9 being operable by a push button 12 which has a stem 13 projecting down into contact with the lever 9 so that when the push botton 12 is depressed, the lever 9 rocks about the fulcrum 10 to lift the operating stem 8 and thus the valve 7 off its seat on the tail 6. The stem 13 forms part of the push button 12.

The flushing valve 7 is retractable into a recess 15 in a guide 16 which is supported from the outlet member 6 in usual manner and above this recess 15 is a division wall 17 which extends across the body 1 of the cistern and has a portion extending over the outlet member and has an upwardly disposed continuation 18 of the wall which again extends frm the front to the back of the body 1 to divide the body into two compartments.

Also extending across the body 1 is a flap 19 which is held by a fulcrum 20 to the tail 6 and is connected by a rod 21 to a further lever 22, which forms a second flush initiating member, which is also supported on a fulcrum 23 on the aforesaid bracket 11 and this lever is in the path of a stem 24 which forms part of a second push button 25 so that when this second push button 25 is depressed the lever 22 will move the rod 21 and this will move the flap 19 towards the end of the wall 17 to at least partially close the aperture 27 between the flap 19 and the end 28 of the wall 17.

The stem 13 is of a width such that it engages only the lever 9 when the button 12 is depressed, but the stem 24 is wider to engage both the lever 9 and the lever 22 so that when the smaller button 25 is depressed the valve 7 is raised to effect a flush but the flap 19 is also actuated to close the aperture 27, thereby preventing the water from the second compartment from discharging.

From the foregoing it will be realised that the cistern body 1 is filled with water to the level indicated by 30 and it will be noted that the extension 18 of the wall 17 terminates below the water level so that the water will flow over the wall 18 to also fill the space between the extension wall 18 and that side of the body 1 of the cistern, the cistern body thus being divided into a first compartment 32 which is smaller and contains the float 4 and a second compartment 33 which is larger and has the water inlet 2 positioned in it.

When it is desired to initiate a small flush, the smaller push button 25 is depressed and through the stem 24 it moves the lever 9 about the fulcrum 10 to lift the operating stem 8 to move the flushing valve 7 into the recess 15, but at the same time it also moves with it the lever 22 about its fulcrum 23 and through the rod 21 at least partially closes the flap 19 and immediately there is a flow of water from the compartment 32 and the compartment 33, the flow from the compartment 33 closing the flap because of its proximity to the end 28 of the wall 17 and the flush then continues only from a compartment 32 until the flush ceases whereupon the valve 7 which was held up into the recess 15 by the flow of water through the tail 6 drops back onto its seat and the flush terminates. The flap remains closed by water pressure until the flow of water ceases from the first compartment 32 and closes when water flows into the first compartment to balance the pressure on the two sides of the flap 19.

Figure 3:
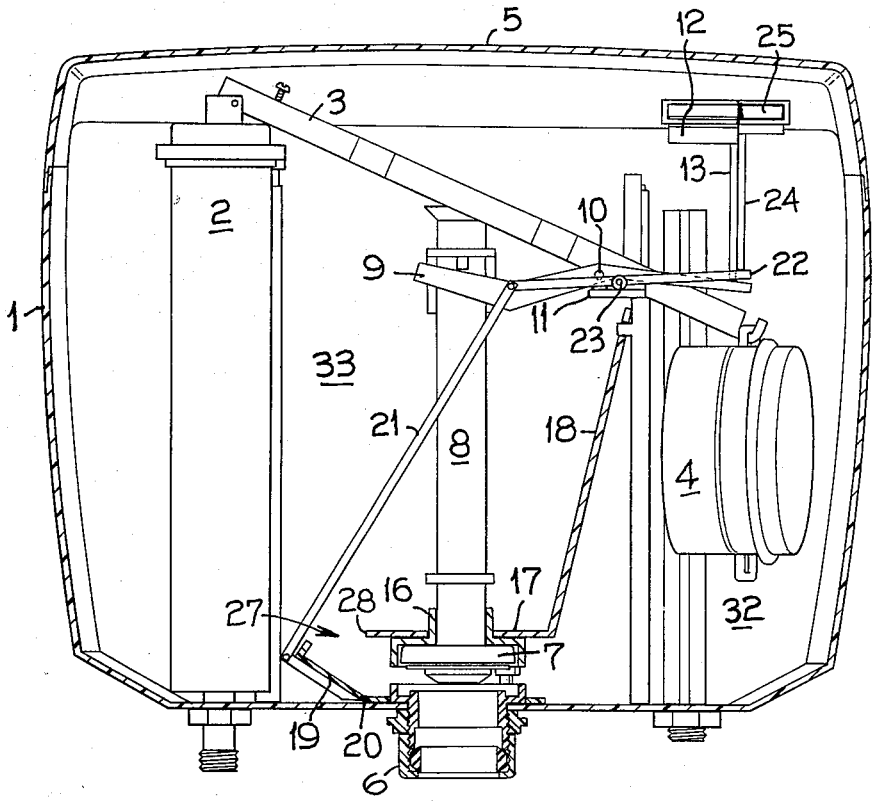
FIG. 3 shows the position after a full flush has terminated but before the flushing valve and flap have returned.

When however a larger flush is required, the larger push button 12 is depressed and through the lever 13 it operates only the lever 9 about the fulcrum 10 but does not actuate the lever 22 so that the aperture 27 remains fully open as shown particularly in FIG. 3 and water then flows from both the first compartment 32 and the second compartment 33 until the valve 7 again leaves the recess 15 to seat on the outlet member 6.

The flap 19 during this time remains open as there is a substantial flow of water through the aperture 27 and this ensures that the flap will remain open as in contradistinction to what occurs when the flap has been moved to almost close the aperture in which case of course the pressure of the water flow then closes the aperture by moving the flap 19 the remainder of the distance.

From the foregoing it will be appreciated that the division wall 17 and its extension 18, acting in conjunction with the flap 19, serves to divide the cistern body into the two compartments, the first being the smaller compartment 32 and the second the larger compartment 33 which can then be caused to empty together, or only the smaller compartment 32 can empty, the water level in the second compartment 33 of course dropping to the height of the top edge of the extension wall 18 when the first compartment 32 is emptied to thereby use the water out of the first compartment 32 as well as the water above the extension wall 18 when a small flush is required.

As stated the actual mechanism for operating the flap can be varied and can be in the nature of a setable arrangement where a preselection is made of the flush capacity independently of the action of starting a flush but it can be associated with the actual member which is used to lift the valve to start a flush so that by appropriate operation of the button which starts the flush the flap is either opened or is left in its closed position or as said two different buttons can be used either of which will commence a flush but one of which will leave the flap in position whereas the other will lift the flap to cause the maximum flush to take place.

In the foregoing description the flap 19 has been described as normally open so that for a large flush it is not moved, but the flap could be normally closed so that to initiate a small volume flush only the flushing valve is actuated but if a large volume flush is required both the flushing valve and the flap are moved to their open positions.

I claim:

1. A variable volume flushing cistern comprising; a body having a division wall across it to form a first compartment and a second compartment, a float in the said first compartment, a water inlet in the said second compartment connected to be actuated by the said float, a flushing valve in the said first compartment positioned to discharge water from the said first compartment and movable by an operating stem passing through the said division wall, a movable flap forming part of the said division wall to allow the said second compartment to be isolated from the said flushing valve in the said first compartment, and means connected to the said flushing valve and the said flap to actuate the said flushing valve only or the said flushing valve and the said flap together, whereby to initiate a large flush from both said compartments or a smaller flush from said first compartment, said division wall having a portion extending over the flushing valve and on one side extending upwardly and on the other side having a portion adapted to be engaged by the said flap, the said flap being hinged to the floor of the said body to define with the division wall the said first and the said second compartments.

2. A variable flushing cistern according to claim 1 wherein the said flushing valve is actuated by a first operating member and wherein the said flap is actuated by a second operating member arranged to operate also the first operating member when the said second operating member is actuated.

3. A variable volume flushing cistern according to claim 2 wherein the said first and the said second operating members are push buttons positioned adjacent to levers, said levers being carried by fulcrums supporting the said levers from the said body, the said lever of the said first push button being coupled to the said flushing valve by connecting means to operate it, the said lever of the second push button being coupled to the said flap by connecting means to operate it and connected to also simultaneously operate the lever of the said first push button.

4. A variable volume flushing cistern according to claim 3 wherein the said connecting means between the said first lever and the flushing valve consist of a hollow stem extending from above the water level in the said cistern to connect to the said flushing valve, said hollow stem opening through the said flushing valve to serve as an overflow during any malfunction of the said float controlled water inlet valve.

5. A variable volume flushing cistern according to claim 3 wherein the said connecting means between the said second lever and the said flap is a rod, said lever of the second push button being adjacent to the lever of the first push button, each said push buttons having a stem, the stem of the first said push button engaging the lever of the first push button, the stem of the second said push button engaging both said levers, whereby both levers are moved by the said second push button.

6. A variable volume flushing cistern comprising; a body to contain water, a water inlet valve in said body near one end thereof, a float in the said body near the other end thereof, an arm connecting the said float to the said water inlet valve whereby to maintain a measured quantity of water in the said body between flushes, a hollow outlet member in a floor of the said body adapted to connect to a flush pipe, a flushing valve adapted to close the said outlet member between flushes, a wall extending across the said cistern body above the said flushing valve and extending upwards in the said body on one side of the said outlet member and adapted to engage a flap on the other side of said outlet member to define a first and a second compartment, said first compartment containing the said float, said second compartment containing the said water inlet valve, said flap being hinged to engage the floor of the said body to engage the said wall on the said other side of the said outlet member, said flap being normally open but movable to prevent flow of water from the said second compartment to the said outlet member, a hollow stem passing through the said wall and connected to the said flushing valve said stem being actuatable to move said flushing valve to initiate a large flush simultaneously from the said first compartment and the said second compartment because of the open flap, and means to move both the said flushing valve and the said flap to close the said flap to initiate a small flush from the said first compartment only.

7. A variable volume flushing cistern according to claim 6 further comprising first and second push button operated levers pivoted to a support on the said cistern body, the first lever being connected to the said flushing valve and the second lever being connected to the said flap, a first said push button being connected to actuate the said first lever of the said flushing valve only to initiate a large flush from the said first and the said second compartments simultaneously, and said means to move the flushing valve and said flap comprises a second push button being connected to actuate both the said first lever of the flushing valve and the said second lever of the flap simultaneously whereby to discharge water from the said first compartment.

* * * * *